US008430534B2

(12) United States Patent
Weekamp et al.

(10) Patent No.: US 8,430,534 B2
(45) Date of Patent: Apr. 30, 2013

(54) LED LAMP AND METHOD FOR PRODUCING THE SAME

(75) Inventors: Johannes W. Weekamp, Beek en donk (NL); Hendrik J. Eggink, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 240 days.

(21) Appl. No.: 13/063,594

(22) PCT Filed: Sep. 11, 2009

(86) PCT No.: PCT/IB2009/053980

§ 371 (c)(1), (2), (4) Date: Mar. 11, 2011

(87) PCT Pub. No.: WO2010/032181

PCT Pub. Date: Mar. 25, 2010

(65) Prior Publication Data

US 2011/0169406 A1 Jul. 14, 2011

(30) Foreign Application Priority Data

Sep. 16, 2008 (EP) ..... 08164391

(51) Int. Cl.
*F21V 29/00* (2006.01)

(52) U.S. Cl.
USPC ..... 362/294

(58) Field of Classification Search ..... 362/294, 362/249.02
See application file for complete search history.

(56) References Cited

U.S. PATENT DOCUMENTS

| | | | |
|---|---|---|---|
| 2006/0050514 | A1 | 3/2006 | Opolka |
| 2006/0232974 | A1 | 10/2006 | Lee et al. |
| 2007/0153518 | A1 | 7/2007 | Chen |

FOREIGN PATENT DOCUMENTS

| | | | |
|---|---|---|---|
| DE | 3220573 | A1 | 12/1983 |
| DE | 19504016 | A1 | 8/1996 |
| DE | 202004013773 | U1 | 12/2004 |
| GB | 2366610 | A | 3/2002 |
| JP | 2000048602 | A | 2/2000 |
| JP | 2004186109 | A | 7/2004 |

*Primary Examiner* — Evan Dzierzynski
(74) *Attorney, Agent, or Firm* — Mark L. Beloborodov

(57) ABSTRACT

The present invention relates to a method for making a global LED lamp (10) having a transparent globe (14) and a base (12) for connecting to a lamp socket. By wrapping the base (12) in expansive foam tape (38) of Compriband type or similar, prior to inserting it in a neck shaped portion (16) of the globe (14), automatic alignment of the base (12) in the globe neck (16) may be obtained. Further, soft metal strips (36) may be wrapped about the tape (38) prior to wrapping the tape (38) about the base (12). The tape (38) acts as an inflatable cushion, which presses the metal strips (36) towards the base (12) and the globe (14). Improved heat transfer between the globe (14) and the base (12) may thus be obtained.

11 Claims, 7 Drawing Sheets

LED LAMP AND METHOD FOR PRODUCING THE SAME

FIELD OF THE INVENTION

The present invention relates to a global LED lamp, comprising a transparent globe, and a base for receiving electrical power from a lamp socket, the base being at least partly located inside a neck shaped portion of the globe and comprising one or more LEDs. The invention further relates to a method for making a global LED lamp.

BACKGROUND OF THE INVENTION

A global LED lamp is a lamp that has the general shape and function of an incandescent light bulb, having a base for connecting to a lamp socket and a transparent globe through which light is transmitted, but its light is emitted from a light emitting diode, LED, inside the globe instead of from an incandescent tungsten wire.

There is a strong need for an efficient method of producing global LED lamps.

US 2006/0050514 A1 discloses a global LED lamp; no details are however given regarding how to efficiently fabricate it.

SUMMARY OF THE INVENTION

It is an object of the present invention to provide an improved method for producing a global LED lamp having a transparent globe and a base for receiving electrical power from a lamp socket. This object is achieved by a method comprising the steps:

a) providing a transparent globe having an opening in a neck-shaped portion, and a base comprising at least one LED;

b) applying an expansive foam member to said base or to an inner surface of the neck portion of the globe;

c) inserting the base into the globe; and d) expanding the expansive foam strip member until it presses against said base and the inner surface of the neck-shaped portion of the globe.

The word transparent in the context of this invention should be interpreted broadly, meaning transparent for light radiation in general, for instance, the globe may be clear, colored, diffuse, frosted, scattering or opaque.

The expansive foam member may, in preferred embodiments, consist of one or several strips of expansive foam. The use of an expansive foam member assists in centering the base in the neck portion of the globe, and fixing it to the globe. Thanks to the expansiveness of the foam member, it is not necessary to have a perfect fit of the base in the neck portion, or to fuse the neck portion with the base or shrink it onto the heat-sink.

Preferably, the expansive foam member has a thermal conductivity k of more than 0.3 W/(m*K), as an increased heat transfer from the base to the globe increases the efficiency of the LED. An increased heat transfer also makes it possible to use LEDs rated at a higher power in the global LED lamp.

In one embodiment, the expansive foam member consists of adhesive expansive foam tape, having an adhesive layer on at least one side. This facilitates assembly of the global LED lamp, and increases the mechanical strength of the resulting global LED lamp.

In one embodiment, a deformable strip of metal is wrapped about the expansive foam member prior to step b). This enhances the heat transfer from the base to the transparent globe even further. Preferably, the metal strip is made of Aluminum and has a thickness of 10-50 μm.

In one embodiment, the base further comprises a LED driver, a first heat-sink for the LED, and a second heat-sink for the LED driver. Further, the expansive foam member comprises a first expansive foam piece and a second expansive foam piece, and in step d), the expansive foam member is expanded until said first expansive foam piece presses against said first heat sink and a first portion of the inner surface of the neck-shaped portion of the globe, and said second expansive foam piece presses against said second heat sink and a second portion of the inner surface of the neck-shaped portion of the globe. By having separate foam pieces connected to the separate heat-sinks, operation of the LED and the LED driver at different temperatures is facilitated, while still maintaining a sufficient heat transfer from the LED as well as the LED driver.

In one embodiment, heat is applied to the expansive foam member in step d), in order to accelerate the expansion of the expansive foam member.

Preferably, the expansive foam member has an expandability of at least a factor three. The expandability of the expansive foam member is defined as how much the expansive foam member increases its thickness, when expanded unobstructed, in free space. For example, an expandability of an expansive foam tape of a factor five means that the tape, after expansion, has a thickness of five times its thickness in its original, compressed state. A high expandability is desired as it will alleviate the geometric tolerance requirements on the globe, the base, and the alignment procedure.

According to another aspect of the invention, there is provided a global LED lamp, comprising a transparent globe, and a base for receiving electrical power from a lamp socket, the base being at least partly located inside a neck shaped portion of the globe and comprising a LED, wherein the global LED lamp further comprises a polymeric foam member between the base and the neck shaped portion of the globe.

Preferably, the foam member has a thermal conductivity k of more than 0.3 W/(m*K). The globe will then act as a cooling flange, and transport heat from the base to the surroundings.

In one embodiment, the global LED lamp comprises a metal strip about the foam member, the foam member pressing the metal strip against the base and the neck shaped portion of the globe. The purpose is to improve the heat transfer from the base to the globe.

In one embodiment, the base further comprises a LED driver, a first heat-sink for the LED, and a second heat-sink for the LED driver, said first and second heat-sinks being at least partly located inside the neck shaped portion of the globe; and the foam member comprises a first foam piece between said first heat-sink and the neck-shaped portion of the globe, and a second foam piece between said second heat-sink and the neck-shaped portion of the globe.

BRIEF DESCRIPTION OF THE DRAWINGS

This and other aspects of the present invention will now be described in more detail, with reference to the appended drawings showing a currently preferred embodiment of the invention.

DETAILED DESCRIPTION

LEDs are typically more efficient than incandescent lamps. However, the voltage supply and lamp sockets in widespread use today are adapted for incandescent lamps; consumers are governed by their habitual idea of what a light bulb should generally look like; and many production facilities are adapted for producing incandescent light bulbs. Ideally, a global LED lamp should be produced on an incandescent light bulb production line with only minor modifications. Further, the product should look like and be capable of being used like an incandescent light bulb. At the same time, the use of an LED instead of a tungsten wire inside the globe of a lamp increases the need for an efficient heat transfer from inside the globe, and reduces the maximum temperature the lamp can be exposed to during production. As an example, the glass globe of an incandescent lamp is typically fused to the base at a temperature high enough to melt the glass, and exposure to such temperatures may damage a LED.

Figure 1:
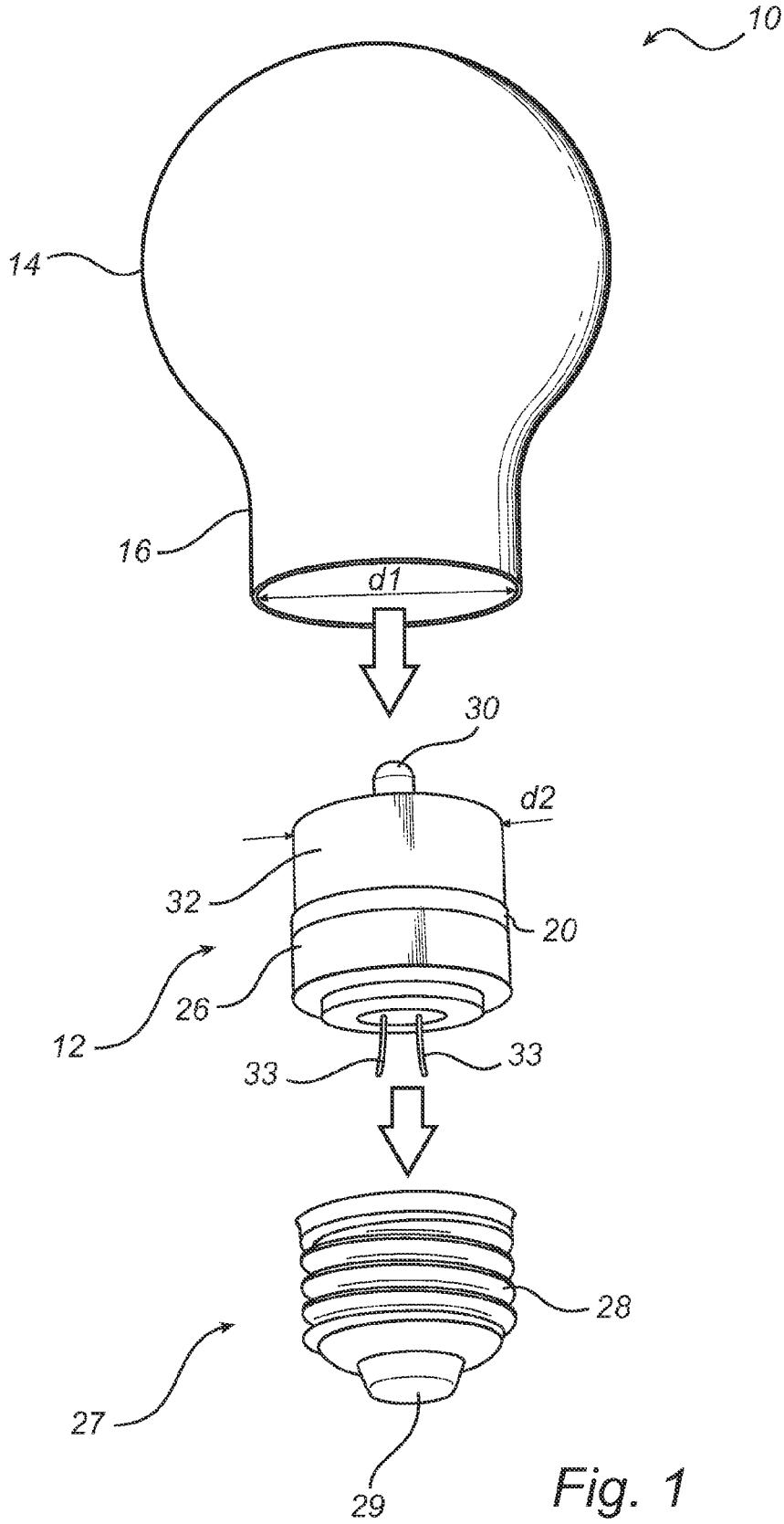
FIG. 1 is a schematic exploded view in perspective of a global LED lamp.

FIG. 1 is an exploded view of an exemplary embodiment of a global LED lamp 10 before assembly using the method of the invention. The global LED lamp comprises a base 12 and a globe 14. The globe 14 has a neck shaped portion 16, which has an opening with an inner diameter d1 that is larger than the diameter d2 of the base 12.

The base comprises a LED driver 24 (FIG. 3), which is thermally connected to a LED driver heat-sink 26, and a LED 30 mounted on a LED heat-sink 32. Two leads 33, for supplying electrical power to the LED driver 24, extend from the base 12. A socket connector 27 is provided with two socket contacts 28, 29, to which the LED driver power leads 33 are to be electrically connected. The two heat-sinks 26, 32 are separated by a thermal isolator layer 20. The LED 30 is arranged to receive a drive current from the LED driver 24 via electrical leads (not shown) inside the base.

Figure 2:
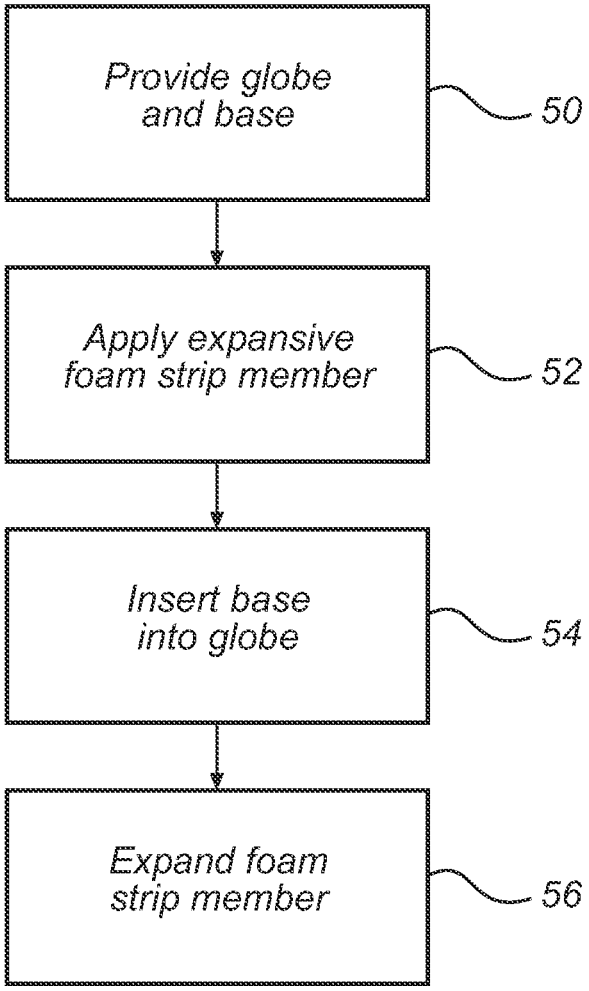
FIG. 2 is a flow chart illustrating a method for producing a global LED lamp.

FIG. 2 is a flow chart illustrating a method for assembling a global LED lamp, e.g. of the type shown in the exploded view of FIG. 1.

In step 50, a transparent globe 14 having an opening in a neck-shaped portion 16, and a base 12 comprising at least one LED 30, are provided. In step 52, an expansive foam member is applied to the base 12 or to an inner surface of the neck portion 16 of the transparent globe 14. The expansive foam member may, in a preferred embodiment, have the shape of a strip. In one particular embodiment, the expansive foam member consists of expansive foam tape; such expansive foam tape is used in the building construction sector for sealing gaps in e.g. concrete floors, and is sometimes called "Compriband". The tape may, in one embodiment, be provided with an adhesive layer on at least one side.

In step 54, the base 12 is inserted into the globe 14.

In step 56, the expansive foam member is expanded until it bridges the gap between the base 12 and the globe 14, thereby interconnecting the base 12 with the globe 14. Expansion of the foam member may be accelerated by heating it to some 120° C. for approximately one hour. Preferably, the expandability of the expansive foam member is at least a factor three, i.e. through the expansion the foam member increases its thickness by a factor three, if allowed an unobstructed expansion. More preferably, the expansive foam member has an expandability of more than a factor five. The expandability of a typical "Compriband" is generally of the order a factor 10.

In a final step, which is optional and not shown in the flow chart, a socket connector 27 may be attached, and electrically connected to the base 12 in a manner well known to those skilled in the art.

Figure 3:
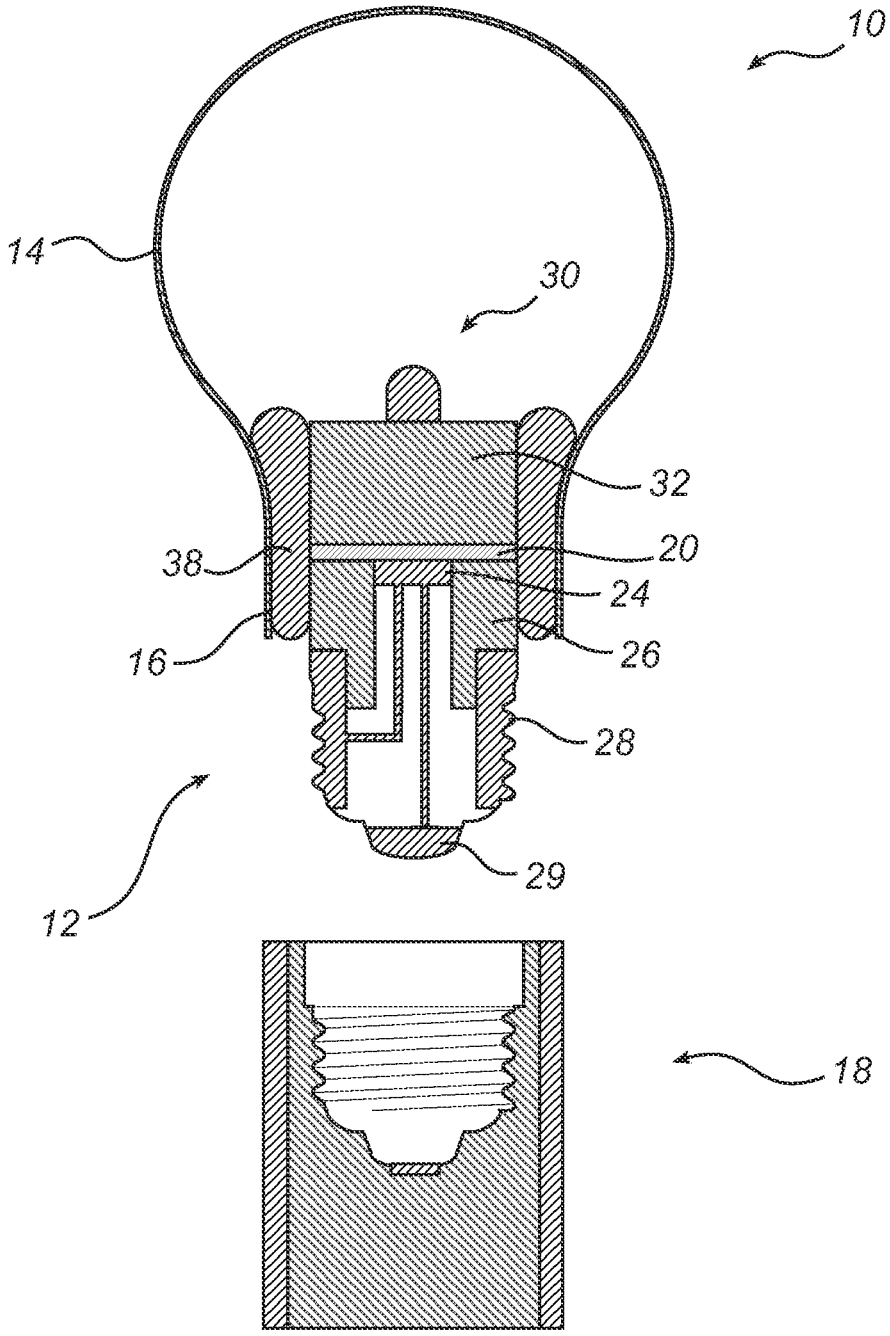
FIG. 3 is a sectional view of a global LED lamp.

FIG. 3 is a sectional view of the global LED lamp 10 of FIG. 1 after assembly. The global LED lamp 10 may have been assembled using the method described with reference to FIG. 2. The gap between the base 12 and the neck portion 16 of the globe 14 is filled with foam 38. Preferably, the foam 38 has a thermal conductivity k of more than 0.3 W/(m*K), and more preferably more than 3 W/(m*K), in order to increase the heat transfer from the heat sink 32 to the globe 14. Most of the heat generated by the LED driver 24 and transported by the LED driver heat-sink 26 is disposed of via a lamp socket 18.

The global LED lamp 10 of FIG. 3 may be produced using an expansive foam strip member, consisting of e.g. expansive foam tape, in accordance with the method described above with reference to FIG. 2. The global LED lamp 10 of FIG. 3 may alternatively be produced by injecting foam into the gap between the heat sink 32 and the neck portion 16 after having positioned the base 12 with the heat sink 32 inside the neck 16. The foam may for instance be a polymeric or plastic foam, preferably having a thermally conductive filler or additive such as metal powder, graphite, boron nitride, silicon nitride, aluminum nitride, titanium nitride, aluminum oxide, beryllia, zirconia, silicon carbide, boron carbide, magnesium hydroxide, magnesium oxide, aluminum hydroxide, or a combination thereof.

Figure 4B:
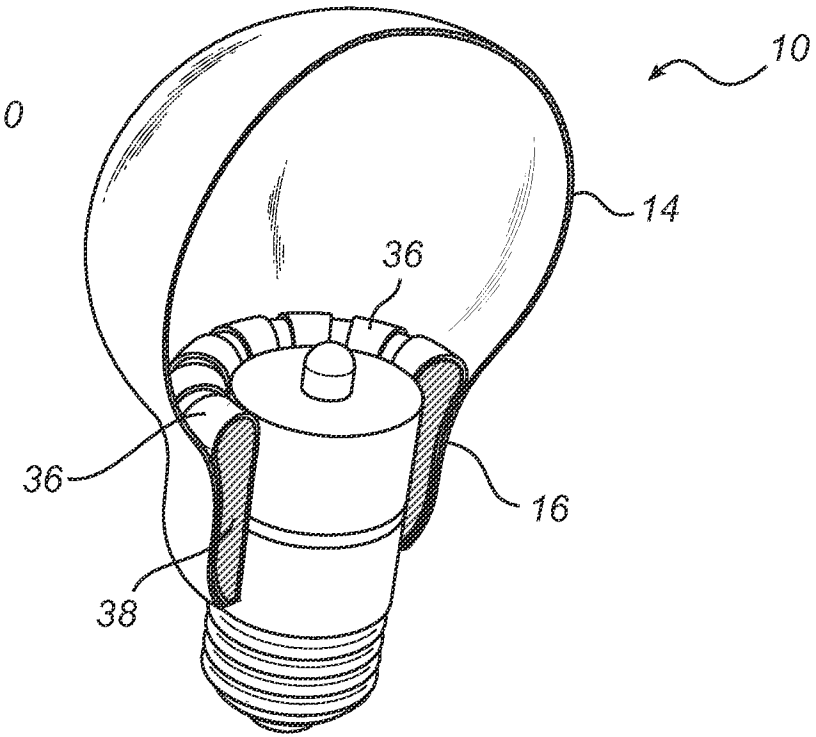
FIGS. 4A and 4B are perspective views, partly in section, of a detail of an alternative embodiment of a global LED lamp.
Figure 4A:
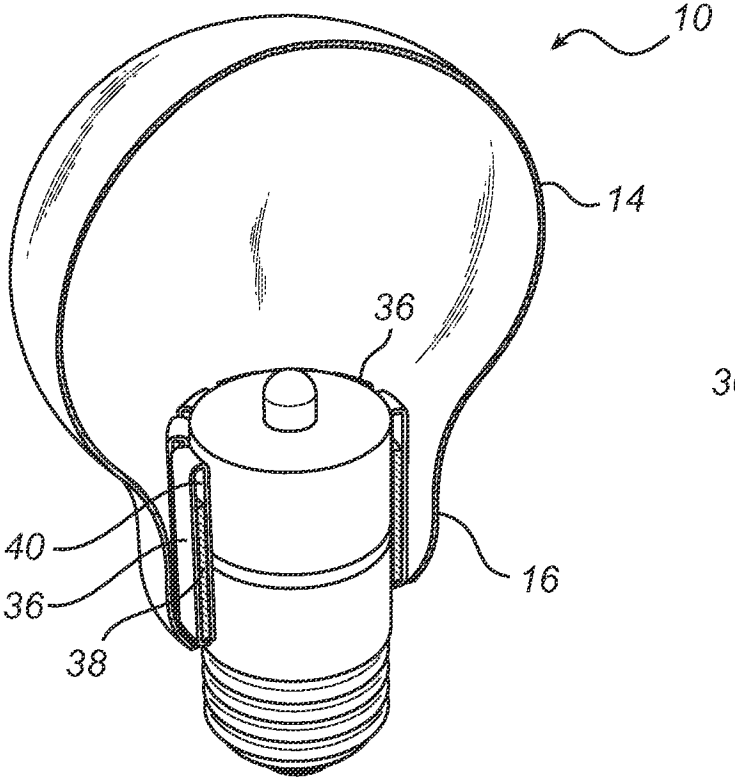

FIGS. 4A-4B illustrate an alternative embodiment of the method described with reference to FIG. 2, wherein, prior to step 52, thin, deformable strips or sheets 36 of a good heat conductor, e.g. aluminum, copper or some other soft metal, are folded, wound or wrapped about a piece of expansive foam tape 38. FIG. 4A shows a detail of a global LED lamp 10 prior to the expansion of the tape 38, and FIG. 4B shows the same detail after the expansion. The strips 36 of FIG. 4A are folded about the tape 38 so as to leave a clearance 40, in order to allow the foam tape 38 to expand sufficiently in step 56. After the expansion, the heat conductive strips 36 are in contact with both the necked portion 16 of the globe 14, and the heat-sink 32, allowing a better flow of heat from the heat-sink 32 to the globe 14.

Figure 5:
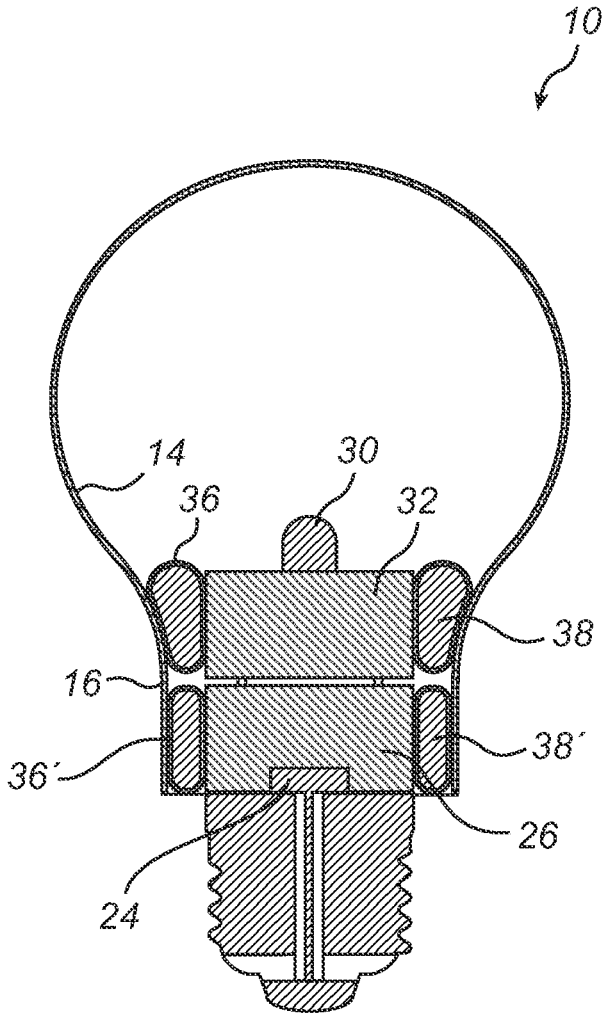
FIG. 5 is a sectional view of a detail of yet another alternative embodiment of a global LED lamp.

FIG. 5 illustrates a detail of a global LED lamp 10 resulting from another embodiment of the method described above with reference to FIG. 2, wherein the expansive foam strip member consists of a first strip of expansive foam tape 38 and a second strip of expansive foam tape 38'. Prior to step 52, deformable aluminum strips 36, 36' are wrapped about the two strips of expansive foam tape. Said first strip of expansive foam tape 38 is then, in step 52, wrapped about the LED heat-sink 32, and said second expansive foam strip 38' is wrapped about the LED driver heat-sink 26. The base is inserted into the globe, and in step 56, two separate heat channels from the respective heat sinks 26, 32 to the globe 14 are created. Using this method, it is possible to transport the heat from the two different heat-sinks 26, 32 to two different locations of the wall of the globe 14, thereby reducing the need for removing the heat from the LED driver heat-sink 26 via a lamp socket. One single expansive foam strip, with or without deformable metal strips, may also be used to transport heat from both heat sinks 26, 32 to the globe 14.

Figure 6A:
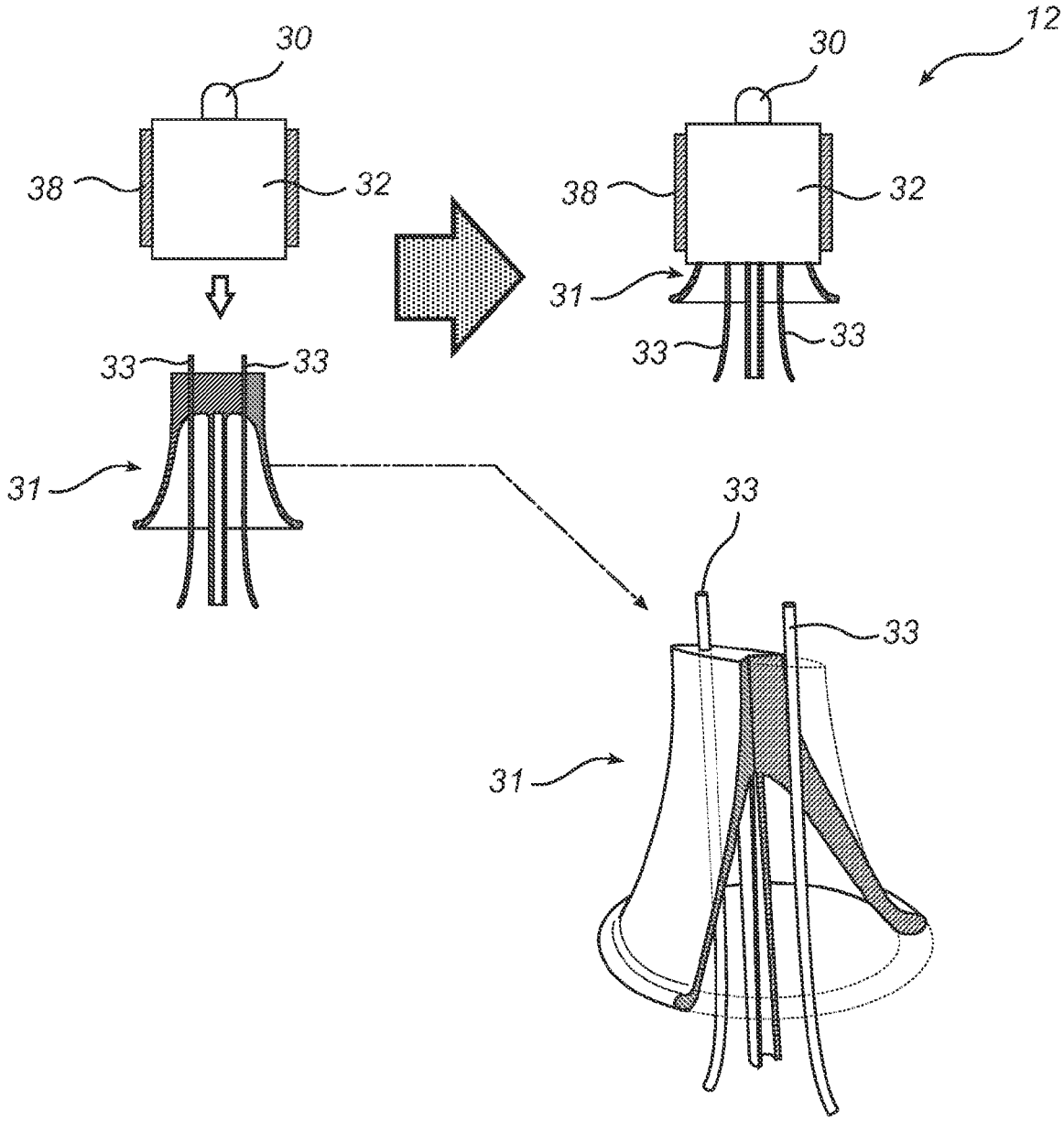
FIGS. 6A-6C are schematic drawings illustrating the assembly of yet another embodiment of a global LED lamp.
Figure 6B:
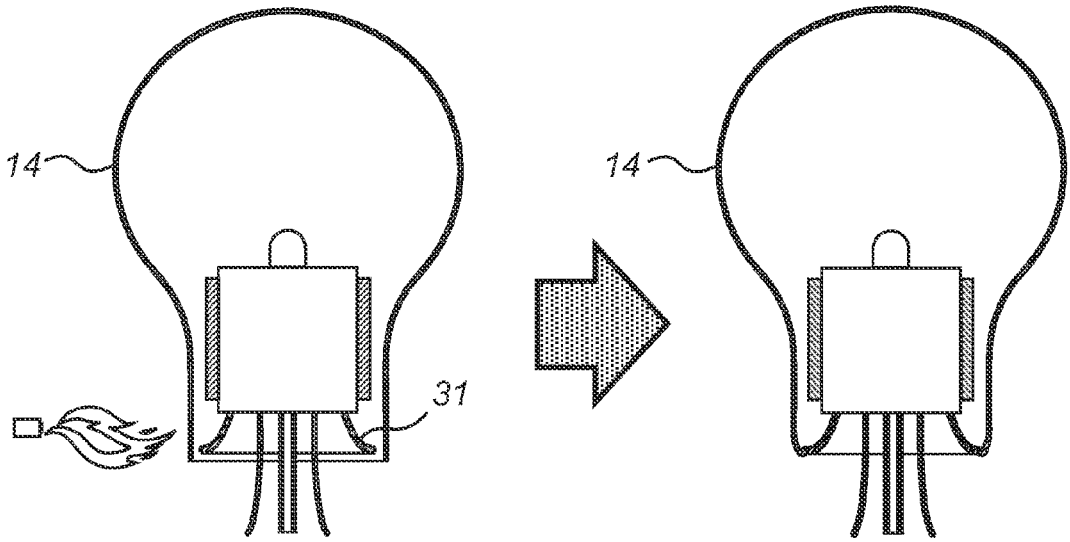
Figure 6C:
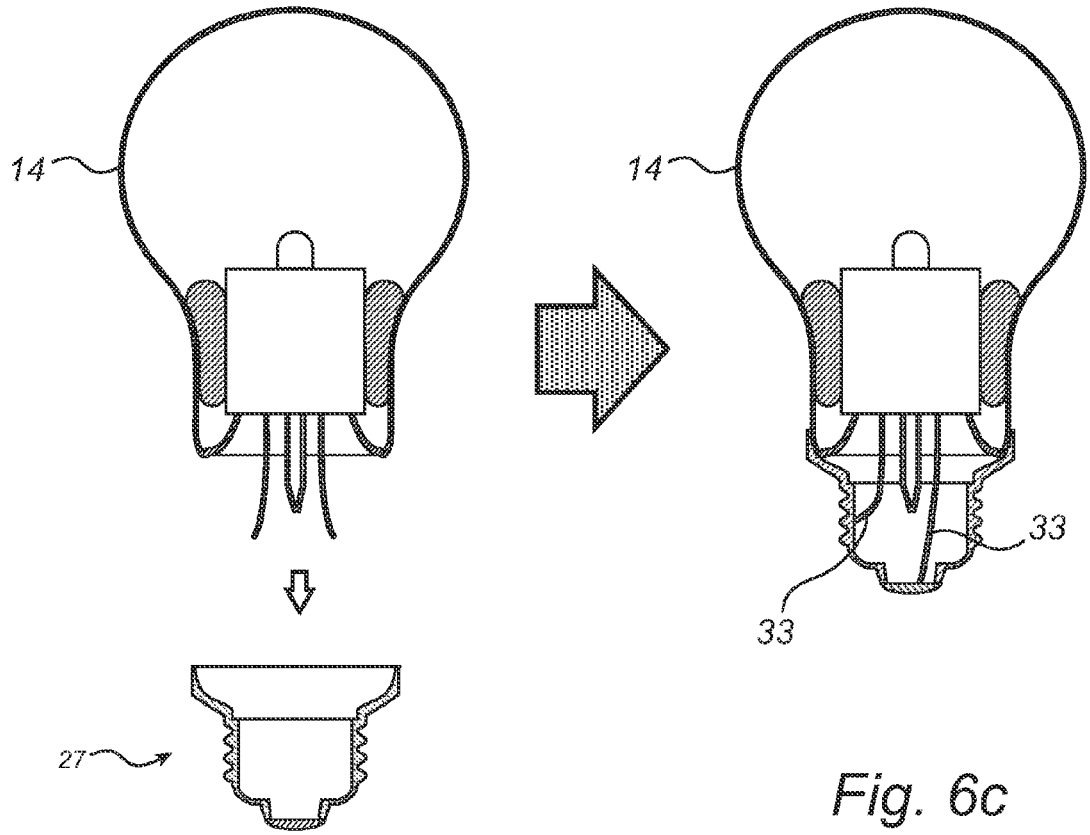

FIG. 6A-C schematically illustrate yet another embodiment of a global LED lamp and a method for fabricating the same. FIG. 6A shows the forming of a base 12 by attaching a glass stem 31 to a LED unit comprising a LED driver, a LED 30, a heat sink 32, and a strip of expansive foam tape 38. The glass stem comprises wires 33 for interconnecting the LED driver with a socket connector.

FIG. 6B shows how a glass globe 14 is fused to the stem 31 by means of a gas burner.

In FIG. 6C, a lower portion of the stem 31 has been pinched off. Furthermore, the expansive foam tape 38 has been expanded as is described more in detail in the foregoing. FIG. 6C shows how a socket connector 27 is attached to the global LED lamp, and how the wires 33 are bent and welded or soldered to the socket connector 27.

It is preferred, but not necessary, that the fusing of the stem 31 to the globe 14 be performed before expanding the expansive foam tape 38. In this manner, the transfer of heat from the glass globe 14 to the LED 30 during the fusing is reduced, thereby reducing the risk of damaging the LED.

In summary, the invention relates to a method for making a global LED lamp having a transparent globe and a base for connecting to a lamp socket. By wrapping the base in expansive foam tape of Compriband type or similar, prior to inserting it in a neck shaped portion of the globe, automatic alignment of the base in the globe neck may be obtained. Further, soft metal strips may be wrapped about the tape prior to wrapping the tape about the base. The tape acts as an inflatable cushion, which presses the metal towards the base and the globe. Improved heat transfer between the globe and the base may thus be obtained.

The person skilled in the art realizes that the present invention by no means is limited to the preferred embodiments described above. On the contrary, many modifications and variations are possible within the scope of the appended claims. For example, the production method described in detail above is not limited to using expansive foam tape. Other forms of strips, ribbons, strings, o-rings, annular seals or the like, which are made of expansive foam, may be used and are covered by the appended claims. Further, the global LED lamp described in detail above may be produced using other methods than the one described in detail above; for example by injecting the foam in a gap between the globe and the base. And even though, in the embodiments described in detail above, the base of the lamp shown comprises a LED driver, the LED driver may as well be located outside the global LED lamp and deliver a drive current to the LED via a lamp socket. The socket connector may be a familiar screw-type, like E14, E26 or E27, or a bayonet fit or another type.

Features disclosed in separate embodiments in the description above may be advantageously combined.

The use of the indefinite article "a" or "an" in this disclosure does not exclude a plurality. Any reference signs in the claims should not be construed as limiting the scope.

The invention claimed is:

1. A method for making an LED lamp comprising a transparent globe having a neck-shaped portion defining an opening therein and a base comprising at least one LED light source and configured for receiving electrical power from a lamp socket, the method comprising:

applying an expansive foam member to said base or to an inner surface of the neck shaped portion of the globe;

inserting at least a portion of the base into the globe; and expanding the expansive foam member until it presses against the base and the inner surface of the neck-shaped portion of the globe.

2. The method according to claim 1, further comprising wrapping a deformable strip of metal about the expansive foam member prior to step the step of applying the expansive member.

3. The method according to claim 1, wherein said base further comprises a LED driver, a first heat-sink for the LED, and a second heat-sink for the LED driver;

said expansive foam member comprises a first expansive foam piece and a second expansive foam piece; and the expansive foam member is expanded until said first expansive foam piece presses against said first heat sink and the inner surface of the neck-shaped portion of the globe, and said second expansive foam piece presses against said second heat sink and the inner surface of the neck-shaped portion of the globe.

4. The method according to claim 1, wherein the expansive foam member comprises adhesive expansive foam tape, having an adhesive layer on at least one side.

5. The method according to claim 1, wherein, heat is applied to the expansive foam member in order to accelerate its expansion.

6. The method according to claim 1, wherein the expansive foam member has a thermal conductivity of more than 0.3 W/(m*K).

7. The method according to claim 1, wherein the expansive foam member has an expandability of at least a factor three.

8. An LED lamp, comprising a transparent globe, and a base for receiving electrical power from a lamp socket, the base being at least partly located inside a neck shaped portion of the globe and comprising a LED, and a polymeric foam member disposed between the base and the neck shaped portion of the globe.

9. The LED lamp according to claim 8, further comprising a metal strip disposed about the foam member, the foam member pressing the metal strip against the base and the neck shaped portion of the globe.

10. The LED lamp according to claim 8, wherein the base further comprises a LED driver, a first heat-sink for the LED, and a second heat-sink for the LED driver, said first and second heat-sinks being at least partly located inside the neck shaped portion of the globe; and the foam member comprises a first foam piece (38) between said first heat-sink and the neck-shaped portion of the globe, and a second foam piece between said second heat-sink end the neck-shaped portion of the globe.

11. The LED lamp according to claim 8, wherein the foam member has a thermal conductivity of more than 0.3 W/(m*K).

* * * * *